US006384308B1

(12) United States Patent
Hoshino

(10) Patent No.: US 6,384,308 B1
(45) Date of Patent: May 7, 2002

(54) HOLDING STRUCTURE FOR A SNARE DRUM

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/620,508

(22) Filed: Jul. 20, 2000

(30) Foreign Application Priority Data

Dec. 27, 1999 (JP) ..... 11-370538

(51) Int. Cl.[7] ..... G10D 13/02
(52) U.S. Cl. ..... 84/421; 84/422.2
(58) Field of Search ..... 84/421, 422.1, 84/422.2, 422.3

(56) References Cited

U.S. PATENT DOCUMENTS 624,662 A * 5/1899 Leddy ..... 84/421
1,837,637 A * 12/1931 Walberg ..... 84/421
2,245,883 A * 6/1941 Walberg ..... 84/421
3,405,587 A * 10/1968 Meazzi et al. ..... 84/421
3,893,363 A * 7/1975 Cohen ..... 84/402
4,987,817 A * 1/1991 Diaz ..... 84/421
5,467,680 A * 11/1995 Kurosaki ..... 84/421
6,060,651 A * 5/2000 Basmadjian ..... 84/411 R

* cited by examiner

*Primary Examiner*—Robert E. Nappi
*Assistant Examiner*—Kim Lockett
(74) *Attorney, Agent, or Firm*—Ostrolenk, Faber, Gerb & Soffen, LLP

(57) ABSTRACT

To prevent the holding arms on a snare drum holder from interfering with either lug bolts on the side of a drum body or a snappy connected below the drum body, there are three snare drum support arms which extend from an upper annular member and are spaced at the unequal angles, not at 120 degrees, so that the arms supporting the snare drum do not pass over or interfere with either the lug bolts or the snappy. The snare drum holding arms are additionally supported by connecting links connected to a lower annular member which is movable along the post on which the upper annular member is held, collapsing or raising the arms for the drum as the lower annular member is moved up and down. The tilt angle of the snare drum holding arms is also adjustable at the post supporting the holder.

9 Claims, 6 Drawing Sheets

HOLDING STRUCTURE FOR A SNARE DRUM

BACKGROUND OF THE INVENTION

This invention relates to a holding structure for a snare drum.

There are two types of snare drums, one having eight lug bolts and the other having 10 lug bolts. FIG. 6 of the attached drawings shows the lower side of a snare drum D1 having eight lug bolts 112. At each angular position that divides the outer periphery of the drum hoop 110 into eight equal parts, there is a lug bolt receiver 111 which protrudes radially provided and eight lug bolts 112 are inserted into the eight receivers for tightening the drum head H on the end of the drum body.

FIG. 7 shows a snare drum D2 with 10 lug bolts. Lug bolt receivers 121 protrude at equidistant angular positions for dividing the outer periphery of the drum hoop 120 into 10 equal parts and the ten lug bolts 122 are inserted into the respective receivers 121 for tightening the drum head H on the drum body.

To hold either snare drum D1 or D2 on a stand, the outer periphery or hoop 110 or 120 at the lower surface of the drum is grasped by three snare drum arms 151, 152 and 153. FIGS. 6 and 7 are cross sections in which the stand supporting the drum has been cut halfway. There is a center shaft 155, a holding arm axial support 156 and a connective arm 157.

The three conventional snare drum holding arms 151, 152 and 153 are provided at angular positions that divide the circumference into three equal parts around the center shaft 155. This has caused a problem in that the receivers 111 and 121 for the lug bolts, which protrude from the hoops 110 and 120 and at least one of the snare drum holding arms 151, 152, and 153 overlap, causing interference.

At an angular position where there is a mutual interference between one of the receivers 111 and 121 for the lug bolts and one of the snare drum holding arms 151, 152 and 153, the holding of the snare drums D1 and D2 becomes incomplete, with the receiver rising or parts that strongly hold the drum being produced, thereby making it impossible to hold the drum with an even force. In this case, it is not only impossible to completely hold the snare drum but the sound produced by the drum is muted, creating an obstacle to smooth performance.

Locations for avoiding the interference were searched for by rotating the snare drums D1 and D2 with respect to the snare drum holding arms 151, 152 and 153. However, only the respective positions shown in FIGS. 6 and 7 provide the least interference. For the drum D1 having eight lug bolts shown in FIG. 6, receivers x and y show interference. For the drum D2 having ten lug bolts shown in FIG. 7, receiver z shows interference. Thus, it has not been possible to position the drums without interference.

Meanwhile, the angle of the snare drum in the horizontal direction can be adjusted by an angle adjusting member of the stand as a performance requires. According to a conventional structure, however, the positions of the three snare drum holding arms are fixed with respect to that of the angle adjusting member, thereby making it impossible to freely change the positions of the snare drum holding arms.

In addition, a snappy S installed on the lower surface of the snare drum has a fixed side holder Sa and an operational side holder Sb which are naturally installed at such positions as will not interfere with the outer tips of the snare drum holding arms 151, 152 and 153.

FIG. 8 shows the snare drum D2 of FIG. 7 viewed from above. When the snare drum holding arms 151, 152 and 153 are fixed on the lower side of the drum as shown in this Figure, and the performer is in position P, the operational side holding part Sb of the snappy S is set at the position of Sb1, which is position R on the right side when the performer operates the lever with his right hand, or at position Sb2 which is position L on the left side when the performer operates the lever with his left hand. Sa1 and Sa2 indicate the fixed side holding parts of the snappy S respectively for operational side holding parts Sa1 and Sa2.

In such a situation, if the performer tries to rotate the operating side holding part Sb1 or Sb2 of the snappy S toward him or slightly toward one side, i.e., if the performer tries to rotate the drum D2 in the circumferential direction, he rotates the stand because the position of the snare drum holding arm is fixed with respect to the angle adjusting member. Thereupon, the snare drum which has been set at a certain angle will also rotate at the same time, causing the beating surface to end up facing sideways. This has made it impossible to rotate the drum, thereby causing the performer to continue performing with a lower degree of operability.

SUMMARY OF THE INVENTION

The holding structure for a snare drum in the prior art causes various problems, which the invention solves. It enables holding the snare drum without interference between the snare drum holding arms and the receivers for the lug bolts and wherein the position of the snare drum holding arms is made rotatable in connection with the angle adjusting member.

The snare drum holding structure of the invention comprises a main stand which includes a main pipe and stand legs and a movable pipe which is supported in the main pipe such that the height of the movable pipe can be freely adjusted. The movable pipe supports a fixed side angle adjustment member at its top. A movable, side angle adjustment member is held such that its rotation angle can be freely adjusted with respect to the fixed side angle adjustment member. The movable member has a center shaft with an outside screw thread of a prescribed length.

A snare drum holder comprises an upper annular member with three holding arm axial support parts provided at angular positions which are not 120 degrees apart by plane sight and are located on the side of the upper annular member which is rotatably held at the top of the center shaft.

A lower annular member has three connective arm axial support parts which are provided at the same angular positions as the holding arm axial support parts of the upper annular member and located on the side of the lower annular member which is installed, freely rotatably, on the center shaft. Three snare drum arms are held to the radially inward ends of the holding arm axial support parts and have the receivers that hold the lower surface outer peripheral part of the snare drum at the tip.

Three connective arms are held by the connective arm axial supports at the lower annular member and are held by the three snare drum holding arms at the tip.

An upper fixed member fixes the upper annular member at the tip of the center shaft. An adjustment nut is arranged on the lower side of the lower annular member and is screwed to the outside screw part of the center shaft to adjust the height of the lower side annular member.

The holding arm axial supports are provided at angular positions of approximately 110 degrees, 115 degrees and 135 degrees by plane sight on the side of the upper tubular main body.

Other objects and features of this invention are explained with reference to the attached drawings.

DESCRIPTION OF PREFERRED EMBODIMENTS

Figure 1:
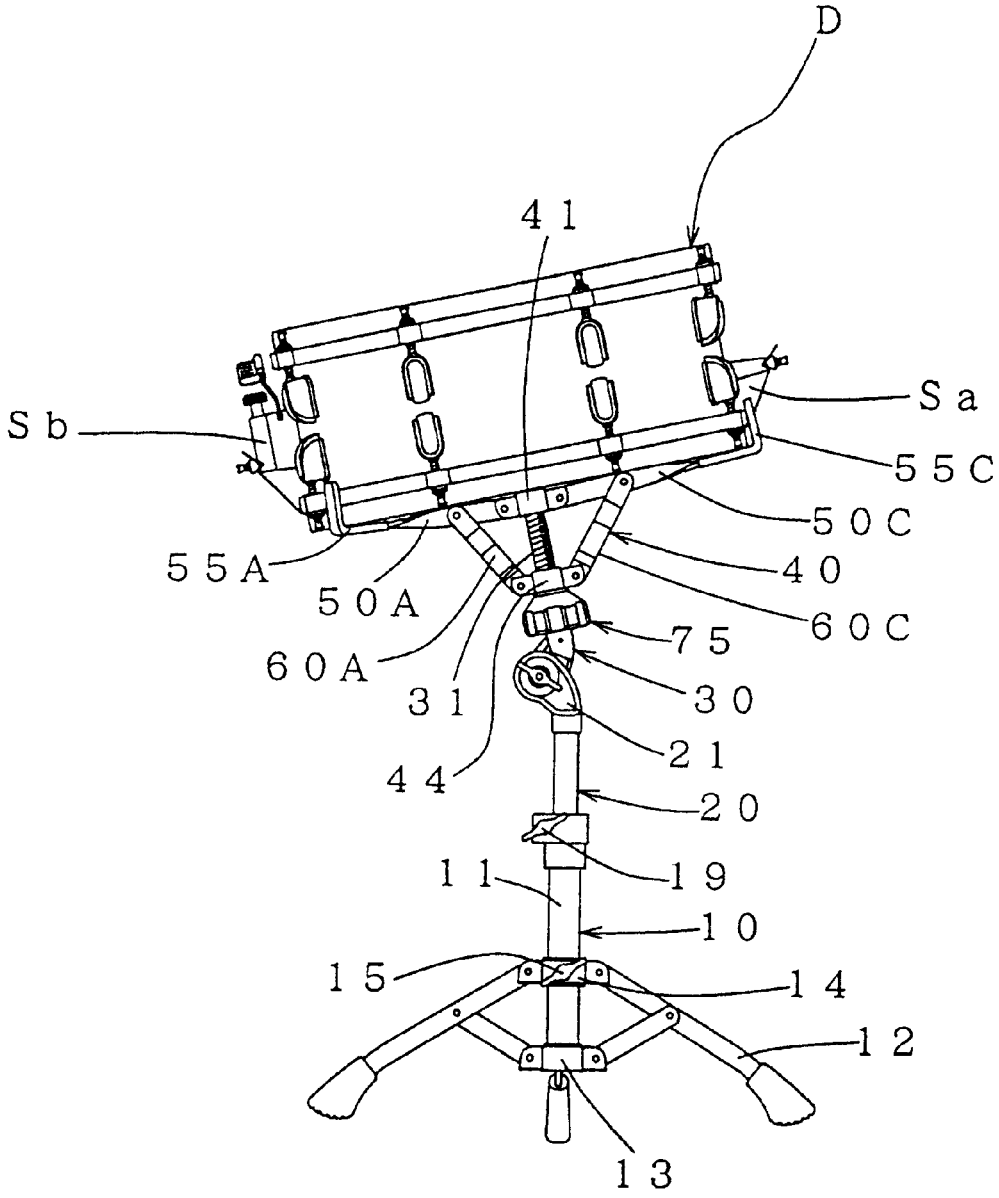
FIG. 1 is a front view of a holding structure of a snare drum according to an embodiment of the invention.
Figure 2:
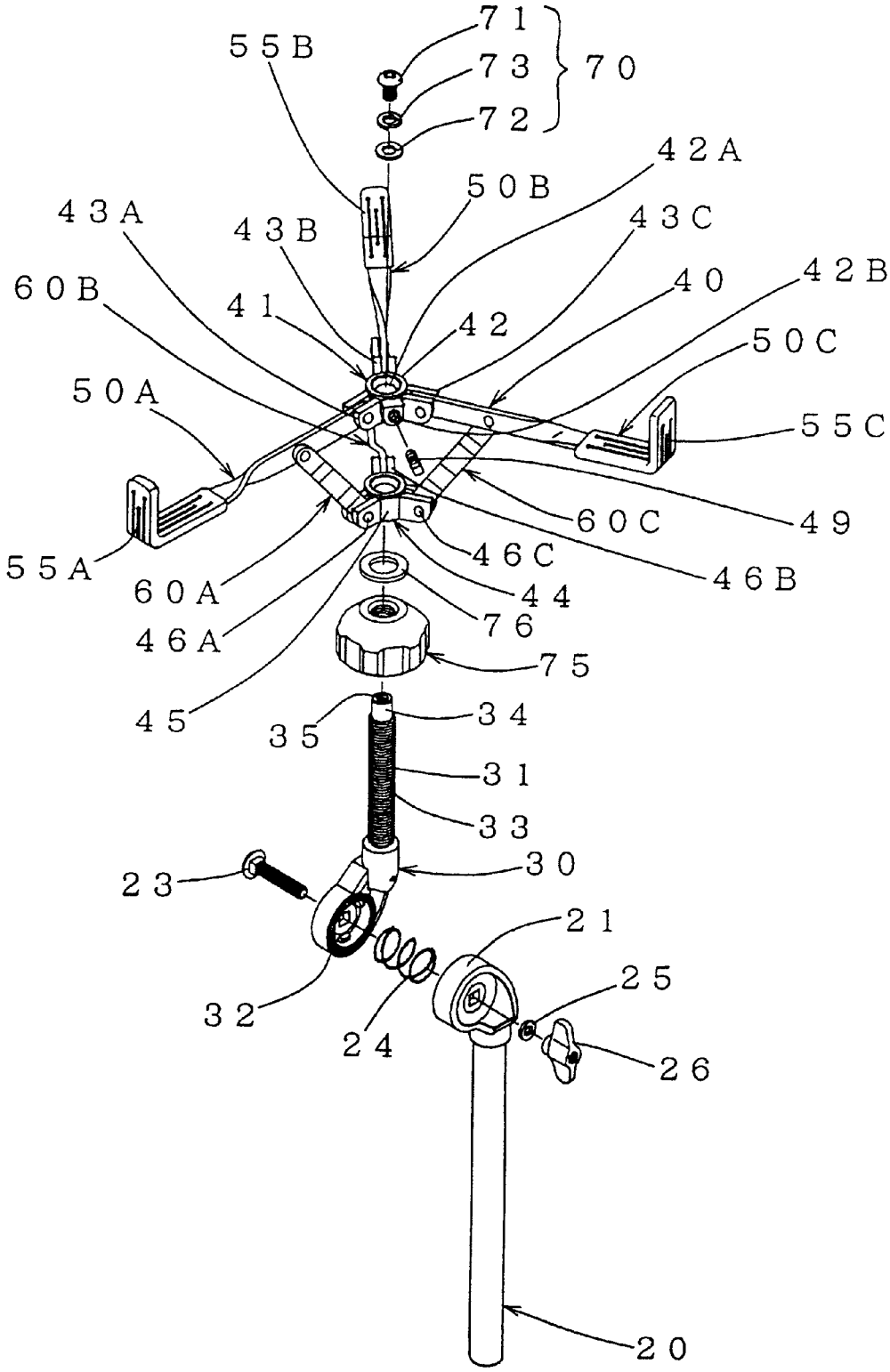
FIG. 2 is an oblique dismantled view.

FIG. 1 shows an entire holding structure for a snare drum of the type having eight lug bolts (D or D1) according to the invention, and FIG. 2 shows its essential parts dismantled. As shown in FIGS. 1 and 2, the holding structure of the invention comprises a main stand body 10, a movable pipe 20 telescopable in the body 10, a movable side angle adjustment member 30 for a drum, a snare drum holding member 40, an upper fixing assembly 70, and an adjustment nut 75.

As shown in FIG. 1, the main stand body 10 has a main pipe 11 and three stand legs 12 with the main pipe 11 at its center. There is a lower side fixed holding (tubular) part 13, an upper movable holding (tubular) part 14 and an adjustment screw 15 for fixing the part 14 on the pipe 11.

The movable pipe 20 is telescopably held, freely adjustable in height, on the main stand body 10. The movable pipe 20 is inserted into the main pipe 11 as shown in FIG. 1 and is freely adjustably fixed as to its height by the adjustment screw 19. A fixed side angle adjustment member 21 is provided at the top of the pipe 20.

The fixed side angle adjustment member 21 at the top of the movable pipe 20 has a known, fixed side gear surface that meshes with a gear surface 32 on an adjacent movable side angle adjustment member 30 to set a desired tilt angle, as shown in FIG. 2.

The movable side angle adjustment member 30 is held at a freely adjustable angle with respect to the fixed side angle adjustment member 21. In this example, the member 30 has a gear surface that meshes with the fixed side gear surface of the fixed side angle adjustment member 21. The member 30 is held freely adjustable as to its rotation angle with respect to the fixed side angle adjustment member 21. A bolt 23 in FIG. 2 serves as the rotation axis. A coil spring 24 is disposed between the adjustment members. A washer 25 is engaged by an adjustment nut 26.

The movable side angle adjustment member 30 supports an upstanding shaft 31 with the outer screw thread 33 of a prescribed length provided on the center shaft 31. The tip of the center shaft is a bar 34 without an outer screw thread 33 and with a diameter smaller than that of the screw thread 33. Inside the tip of the shaft 31, there is an opening with an inside screw thread 35 that receives the bolt 71 of the upper fixed member 70.

The snare drum holder 40 has an upper side annular member 41, a lower side annular member 44, snare drum holding arms 50A, 50B and 50C and connective arms 60A, 60B and 60C between the arms 50 and the member 44.

Figure 3:
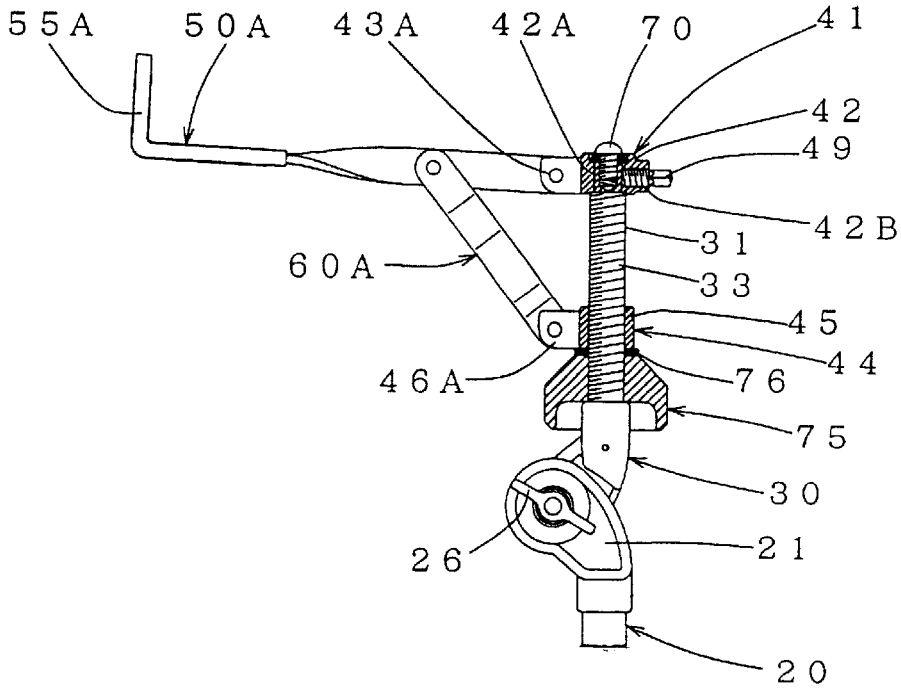
FIG. 3 is a cross section of part of the assembly.

The upper annular member 41 is comprised of an upper main tubular body 42 and three holding arm axial supports 43A, 43B and 43C. As shown in FIG. 3, the upper side body 42 has an interior hole 42A with a smaller diameter than that of the outside screw thread 33 of the shaft 31. That diameter is suitable for insertion of the tip of the bar 34, as shown in FIG. 3 and the body 42 is mounted on the bar 34 to be held freely rotatably on the shaft 31.

A screw hole 42B provided in the side of the tubular body 42 receives a fixing screw 49 which contacts the bar 34 at the tip of the center shaft 31. This enables prevention of the rotation of the upper tubular body 42, to fix it.

Figure 4:
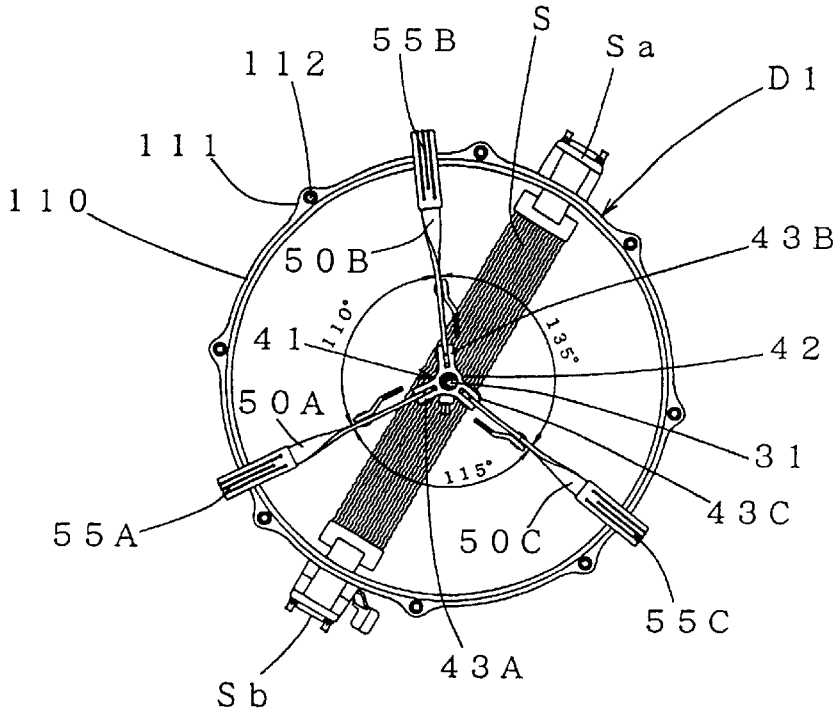
FIG. 4 is a cross section thereof, as viewed from the lower surface of a snare drum having eight lug bolts.

The three holding arm axial supports 43A, 43B and 43C of the upper annular member 41 are for fixing three snare drum holding arms 50A, 50B and 50C to the upper annular member 41. As shown in FIG. 4, the three axial supports 43A, 43B and 43C are arrayed around upper main tubular body 42 spaced at angles other than 120 degrees apart. In this example, they are spaced at angles of 110 degrees, 115 degrees and 135 degrees apart around the upper tubular body 42 as the center. Various parts of the snare drum D1 and the snappy S are identified with the same reference numbers as earlier noted.

The lower annular member 44 is comprised of a lower main tubular body 45 and three connective arm axial supports 46A, 46B and 46C. As shown in FIG. 3, the main lower side tubular body 45 has a diameter sufficient for insertion of the outer screw thread 33 of the shaft 31, to be freely rotatable thereon. The height position of the member 44 is adjustable because it is supported from below by an adjustment nut 75.

The three connective arm axial supports 46A, 46B and 46C of the lower annular member 44 hold the three connective arms 60A, 60B and 60C on the lower annular member 44. These three connective arm axial supports 46A, 46B and 46C are arrayed around the lower side tubular body 45 at the same angle positions as the three holding arm axial supports 43A, 43B and 43C above them.

The snare drum holding arms 50A, 50B and 50C hold the snare drum D1. They are made of three platelike members bent up by 90 degrees. The tips of the snare drum holding arms 50A, 50B and 50C have the bent up receivers 55A, 55B and 55C that contact the lower side outer periphery of the snare drum D1. The receivers 55A, 55B and 55C comprise the platelike members which are bent upward in the shape of an L and are covered with rubber, etc. In addition, the radially inward or rear parts of the arms 50A, 50B and 50C are held to the axial supports 43A, 43B and 43C.

The connective arms 60A, 60B and 60C support the snare drum holding arms 50A, 50B and 50C from below. The arms 60 comprise three platelike members. The tips of the arms 60A, 60B and 60C are attached at the middle of the respective ones of the three holding arms 50A, 50B and 50C and are also held at their lower ends to connective arm axial support parts 46A, 46B and 46C.

As is shown in FIGS. 2 and 3, the upper fixed member 70 is rotatable to install the upper annular member 41 of the snare drum holder 40 at the bar 34 at the tip of the shaft 31. The upper member 70 is comprised of a bolt 71, a washer 72, and a spring washer 73, wherein the bolt 71 is screwed into the interior screw thread 35 in the tip of the shaft 31 through the spring washer 73, the washer 72 and the upper main tubular body 42.

The adjusting nut 75 is arranged below the lower side annular member 44 and the nut 75 is screwed on the outer screw thread 33 of the center shaft to set the height of and to support the lower side annular member 44. As the adjusting nut 75 is moved up and down, the height of the lower annular body 44 is adjusted. This makes it possible to hold the snare drum D1 and to loosen its holding.

When the adjusting nut 75 is twisted to move it upward, the lower annular member 44 shifts upward, collapsing the connective arms 60A, 60B and 60C toward each other and contracting the snare drum holding arms 50A, 50B and 50C inwardly. If the adjusting nut 75 is twisted to move it downward, on the other hand, the lower annular member 44 moves downward, opening the connective arms 60A, 60B and 60C apart and making it possible for the snare drum holding arms 50A, 50B and 50C to be expanded outwardly.

A washer 76 is arranged between the adjusting nut 75 and the lower annular member 44.

In the holding structure of the snare drum described above, three arm axial supports are provided so that the three snare drum holding arms, in particular, may be positioned at angular positions which are not 120 degrees apart so that there will be no interference between the lug bolt receiving part 111 and the snare drum holding arms 50A, 50B and 50C, as contrasted with a snare drum D1 having eight lug bolts 112 held as shown in FIG. 4, for example.

Figure 5:
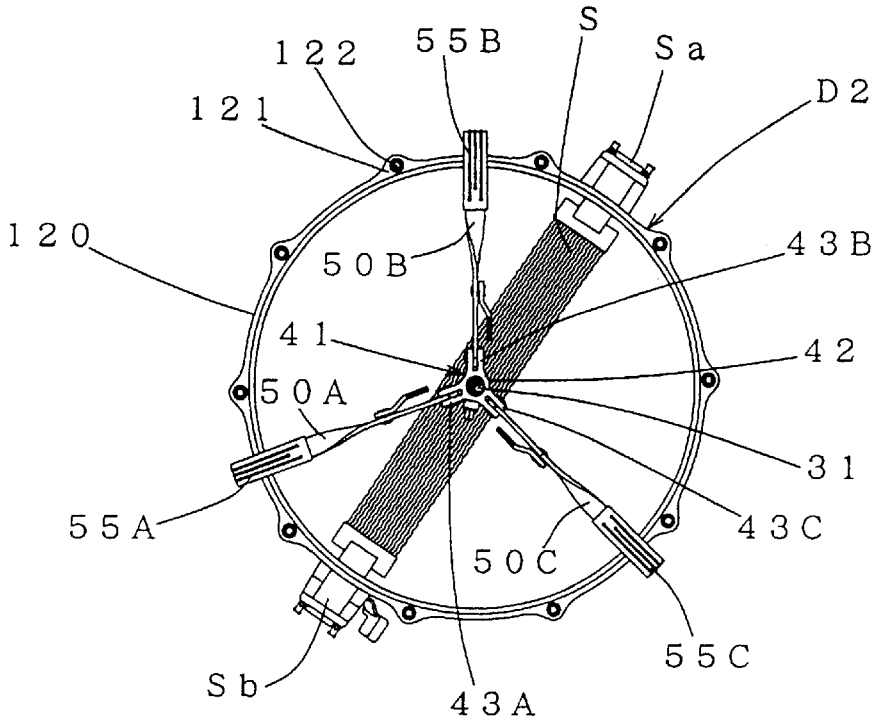
FIG. 5 is the same cross section of a snare drum having ten lug bolts.
Figure 6:
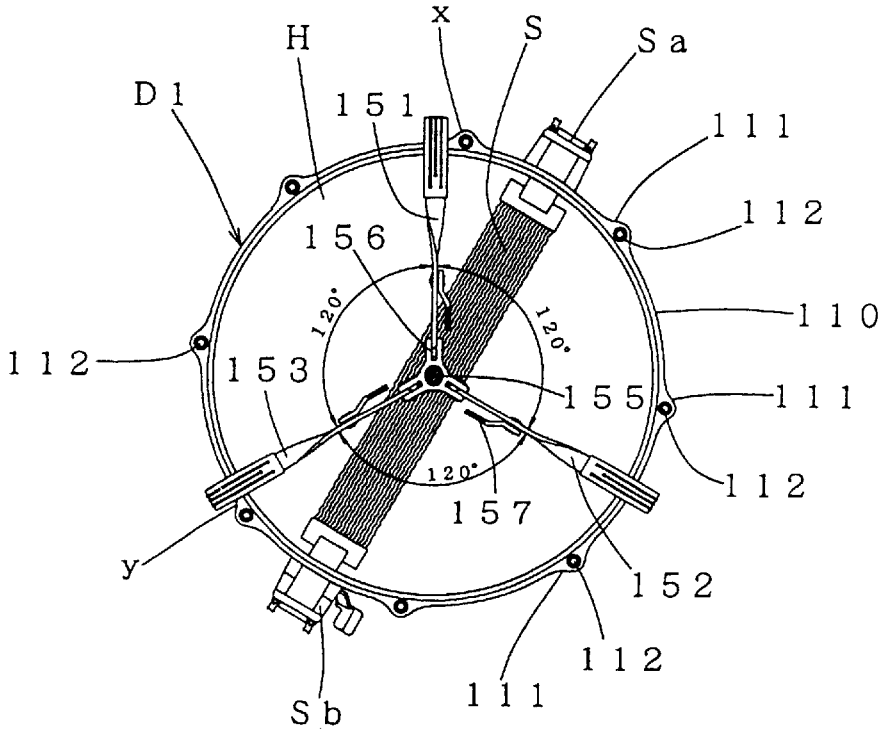
FIG. 6 is a cross section from below of a snare drum having eight lug bolts according to prior art.
Figure 7:
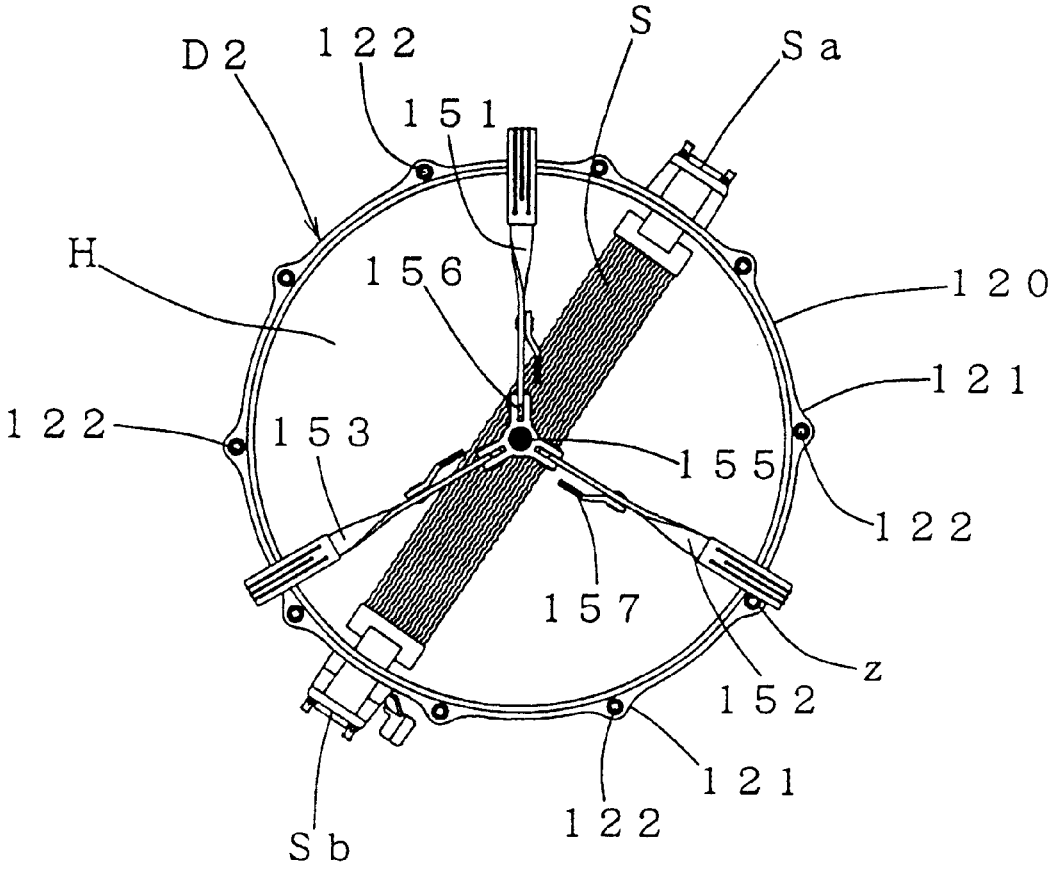
FIG. 7 is a cross section from below of a snare drum having ten lug bolts according to prior art.
Figure 8:
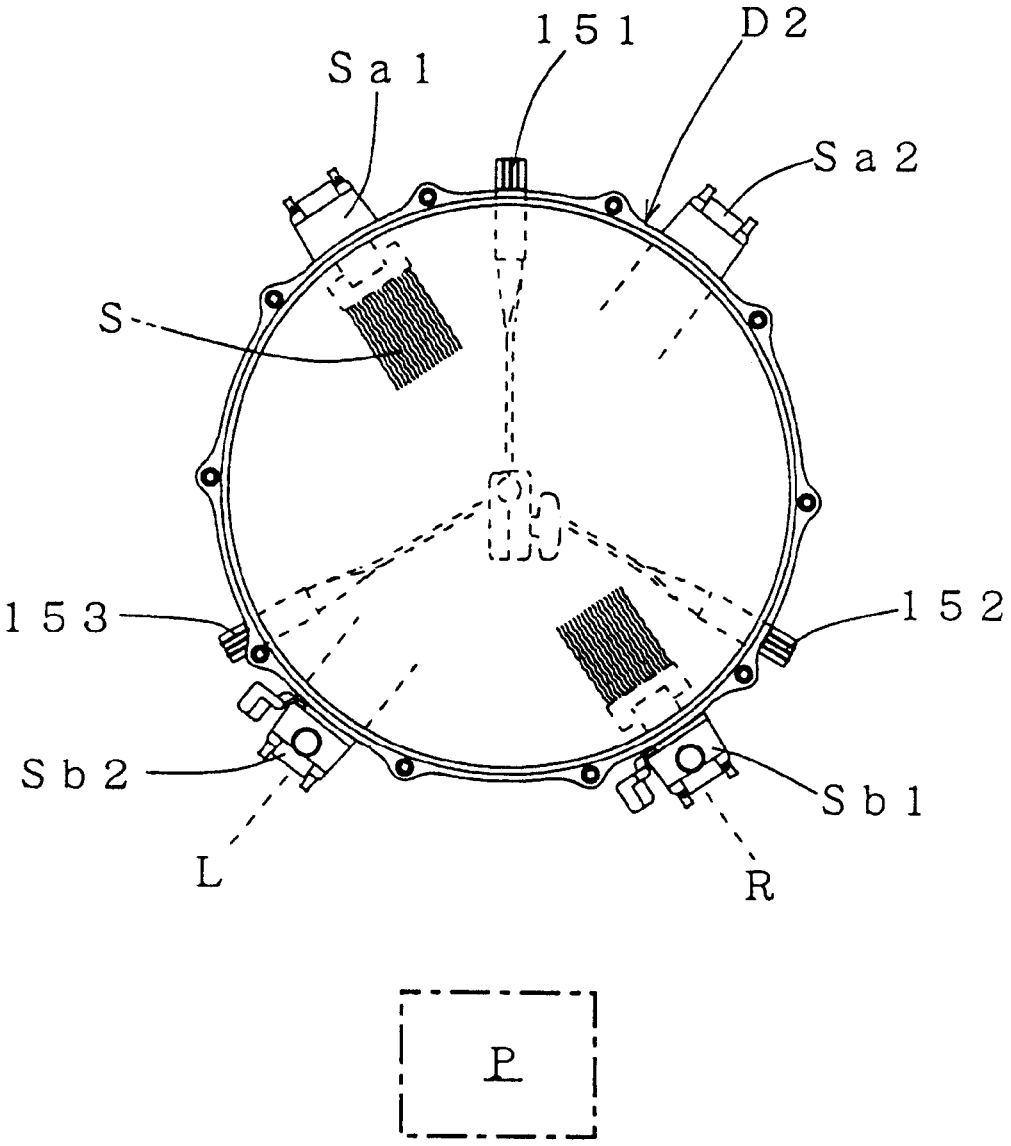
FIG. 8 shows a positional relationship between the snappy holding part of a conventional snare drum and a performer.

When a snare drum D2 of the type having ten lug bolts 122 is being held, as shown in FIG. 5, there is no interference between the receiving part 121 for the lug bolts and the snare drum holding arms 50A, 50B and 50C in contrast with past designs.

Because the upper side main tubular body 42 is freely rotatable with respect to the center shaft 31, the position of the snare drum holding arms may be rotated with respect to the angle adjusting member. This makes it possible, for instance, to change the position of the operating side holding part of the snappy according to the wishes of the performer.

The holding structure for a snare drum of the invention makes it possible to firmly hold the snare drum without any interference between the snare drum holding arms and the receiving parts for the lug bolts. As the position of the snare drum holding arms is freely rotatable with respect to the angle adjusting member, moreover, the performer may shift the operating side holding part of the snappy to a position where it is easier for the performer to position himself. In this manner, various problems surrounding the snare drum holding can be solved all at once.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A holding structure for a snare drum comprising a main stand body, legs supporting the body, a snare drum holder on the body comprising an upstanding pipe;

an upper annular member around the pipe, three holding arm supports disposed at angular positions which are not uniformly spaced apart around the upper annular member, a securing device for securing the upper annular member to the pipe;

a respective snare drum holding arm held to each of the holding arm supports and a respective receiving part for the lower surface of the peripheral part of the snare drum at each of the holding arms;

a lower annular member below the upper annular member and around the pipe, the lower annular member having three connective arm axial supports positioned around the lower annular member respectively at the same angular positions as the holding arm supports around the upper annular member, and the lower annular member is freely rotatably positioned around the pipe;

an adjustment device for adjusting the height position of the lower annular member;

a respective connective arm connected between the holding arm supports and the connective arm axial supports.

2. The holding structure of claim 1, wherein the three holding arm supports around the upper annular member are provided at angular positions which are not 120 degrees apart with respect to each other around the annular member.

3. The holding structure of claim 1, wherein the pipe has a tip at the top thereof and the upper annular member is rotatably held at the tip of the pipe.

4. The holding structure of claim 3, further comprising an upper fixing member for fixing the upper annular member at the tip of the pipe.

5. The holding structure of claim 1, wherein the pipe includes a first side angle adjustment member and a second movable side angle adjustment member, wherein the first and second side angle adjustment members are held together for adjusting the tilt of the snare drum holder.

6. The holding structure of claim 5, wherein the pipe is vertically adjustable with respect to the legs of the stand for adjusting the height of the snare drum holder.

7. The holding structure of claim 2, wherein the holding arm supports are spaced apart from each other at angular positions of approximately 110 degrees, 115 degrees and 130 degrees around the upper annular member.

8. In combination, the snare drum holding structure of claim 1 and a snare drum;

the snare drum has a bottom side, a periphery, a plurality of lug bolts arrayed around the periphery at the bottom side of the drum, and the angle between the upper holding arm axial supports is selected so that the snare drum holding arms extend to the periphery of the snare drum and do not pass over and interfere with the lug bolts on the periphery of the snare drum.

9. The combination of claim 8, wherein the snare drum includes a snappy extending across the bottom side of the snare drum at positions at opposite sides of the snare drum between the lug bolts and the positions of the holding arm supports around the snare drum are selected so that the snare drum holding arms do not pass over or interfere with the snappy at the periphery of the snare drum.

* * * * *